US008707695B2

(12) United States Patent
Niiyama et al.

(10) Patent No.: US 8,707,695 B2
(45) Date of Patent: Apr. 29, 2014

(54) HEAT ENGINE

(75) Inventors: Yasunori Niiyama, Kuwana (JP); Shinichi Yatsuzuka, Nagoya (JP); Tsuyoshi Morimoto, Obu (JP); Kentarou Fukuda, Kariya (JP)

(73) Assignee: Denso Corporation, Kariya (JP)

( * ) Notice: Subject to any disclaimer, the term of this patent is extended or adjusted under 35 U.S.C. 154(b) by 228 days.

(21) Appl. No.: 12/932,849

(22) Filed: Mar. 8, 2011

(65) Prior Publication Data

US 2011/0219765 A1 Sep. 15, 2011

(30) Foreign Application Priority Data

Mar. 10, 2010 (JP) ..... 2010-53397
Feb. 10, 2011 (JP) ..... 2011-26842

(51) Int. Cl.
*F03C 1/00* (2006.01)

(52) U.S. Cl.
USPC ..... 60/531; 60/526

(58) Field of Classification Search
USPC ..... 60/531, 39.63, 39.64, 516, 526, 655; 62/202, 205, 224
See application file for complete search history.

(56) References Cited

U.S. PATENT DOCUMENTS 3,640,433 A * 2/1972 Rodth ..... 222/129.2
3,649,136 A * 3/1972 Ruidisch ..... 417/404
3,908,395 A * 9/1975 Hobbs ..... 62/346
4,418,547 A * 12/1983 Clark, Jr. ..... 62/116
4,617,801 A * 10/1986 Clark, Jr. ..... 62/116
4,747,271 A * 5/1988 Fischer ..... 60/670
4,816,121 A * 3/1989 Keefer ..... 204/156
6,076,355 A * 6/2000 Ven et al. ..... 60/655
7,191,738 B2 * 3/2007 Shkolnik ..... 123/19
7,669,415 B2 * 3/2010 Komaki et al. ..... 60/531
8,021,124 B2 * 9/2011 Umemura et al. ..... 417/222.2
2004/0060294 A1 4/2004 Yatsuzuka et al.

FOREIGN PATENT DOCUMENTS

JP 10-252556 9/1998
JP 10-252557 9/1998
JP 2004-84523 3/2004

* cited by examiner

*Primary Examiner* — Thomas Denion
*Assistant Examiner* — Shafiq Mian
(74) *Attorney, Agent, or Firm* — Harness, Dickey & Pierce, PLC

(57) ABSTRACT

A heat engine includes a container in which a liquid piston made of a liquid operation fluid is sealed to flow therein, an exterior evaporator located outside of the container to generate vapor of the operation fluid, a suction portion arranged at one end side of the container to draw the vapor generated in the exterior evaporator into the container, an expansion portion in which the vapor drawn into the container is expanded to cause a displacement of the liquid piston, an output portion arranged at the other end side of the container to convert the displacement of the liquid piston to a mechanical energy, a liquid piston discharge portion for discharging a part of the liquid operation fluid as the liquid piston from the container, and a vapor discharge portion configured to discharge the vapor without being condensed in the container to outside of the container.

20 Claims, 6 Drawing Sheets

HEAT ENGINE

CROSS REFERENCE TO RELATED APPLICATION

This application is based on Japanese Patent Applications No. 2010-053397 filed on Mar. 10, 2010, and No. 2011-026842 filed on Feb. 10, 2011, the contents of which are incorporated herein by reference in its entirety.

FIELD OF THE INVENTION

The present invention relates to a heat engine, which displaces a liquid piston by a vapor expansion, and converts a displacement of the liquid piston to a mechanical energy.

BACKGROUND OF THE INVENTION

For example, a heat engine is described in Patent Document 1 (JP 2004-84523A corresponding to US 2004/0060294A1) and Patent Document 2 (JP 10-252556A). In the heat engine of Patent Document 1, the liquid piston made of a liquid fluid is sealed in a tube container, and a part of the liquid piston is heated by a heating portion provided at one end side of the container so as to generate vapor. The vapor is cooled and condensed in a cooling portion formed at a middle portion of the container, thereby causing a volume change of the vapor. By the volume change of the vapor in the container, the liquid piston is displaced in the container so that the displacement of the liquid piston is converted to a mechanical energy in the heat engine.

In the heat engine described in Patent Document 2, a liquid piston made of a liquid fluid is sealed in a main container, and a liquid is sealed in a separation container separated from the main container. Vapor is generated by heating the liquid sealed in the separation container, and is supplied to one end portion of the main container at a predetermined timing. Then, the vapor is cooled and condensed in a cooling portion provided at a middle portion of the main container, so that the liquid piston is displaced to be reciprocated in the main container.

In the heat engine of Patent Document 1, a part of the liquid fluid as the liquid piston is evaporated by the heating portion. When the liquid piston is moved to a cooling portion without being evaporated in the heating portion, the liquid piston is adapted to only transfer the heat quantity from the heating portion to the cooling portion, and thereby the heat quantity from the heating portion becomes heat loss and cannot be output as the mechanical energy. Because heat loss (heat transferring loss) is generated, an energy conversion efficiency from the heat energy to the mechanical energy is decreased.

In the heat engine of Patent Document 2, because the liquid in the separation container separated from the main container is heated to generate the vapor, the above problem of the Patent Document 1 is not caused.

However, in the heat engine of the Patent Document 2, it is difficult to avoid that a non-condensable gas (e.g., air) mixes in the vapor supplied to the main container and the non-condensable gas is accumulated into the main container. Thus, not only a compression loss for compressing the non-condensable gas occurs, but also the cooling of the vapor in the cooling portion is restricted by the non-condensable gas, and thereby a loss for compressing the vapor, which is not condensed by the cooling portion, is caused.

As a result, the heat energy conversion efficiency is decreased.

The present invention is made in view of the above matters, and it is an object of the present invention to provide a heat engine, which can effectively improve heat energy conversion efficiency.

SUMMARY OF THE INVENTION

In view of the foregoing problems, it is an object of the present invention to provide a heat engine which can effectively improve heat energy conversion efficiency.

A heat engine includes a container with a tube portion, in which a liquid piston made of a liquid operation fluid is sealed to flow therein; an exterior evaporator located outside of the container to generate vapor of the operation fluid; a vapor suction portion arranged at one end side of the container to draw the vapor generated in the exterior evaporator into the container; an expansion portion provided in the container, in which the vapor drawn from the vapor suction portion is expanded to cause a displacement of the liquid piston in the container; an output portion arranged at the other end side of the container to convert the displacement of the liquid piston to a mechanical energy and to output the converted mechanical energy; a liquid piston discharge portion configured to discharge a part of the liquid operation fluid as the liquid piston from the container, so as to restrict an increase of an amount of the liquid piston in the container; and a vapor discharge portion configured to discharge the vapor without being condensed in the container to outside of the container. Accordingly, it is possible to discharge the vapor that is not completely condensed in the container, to outside of the container by the vapor discharge portion, thereby preventing the uncondensed vapor from being compressed in a compression stroke. As a result, a heat energy conversion efficiency can be effectively improved.

For example, the vapor discharge portion may be arranged at the one end side of the container. In this case, the vapor discharge portion may be provided with a vapor discharge port from which the vapor is discharged, and the vapor discharge port may be closed when the liquid piston is most approached to the vapor discharge portion.

Alternatively, the liquid piston discharge portion may discharge a part of the liquid operation fluid as the liquid piston, when an inner pressure of the container is larger than a predetermined pressure. In this case, the predetermined pressure may be higher than a pressure of the vapor drawn from the vapor suction portion into the container.

Alternatively, the liquid piston discharge portion may be arranged at a lower side of the vapor suction portion such that a part of the liquid operation fluid as the liquid piston is discharged by using a fluid head pressure. Alternatively, the liquid piston discharge portion and the vapor discharge portion may be provided with a common discharge port used in common for the liquid piston discharge portion and the vapor discharge portion, such that a part of the liquid operation fluid as the liquid piston is discharged from the container via the common discharge port.

The heat engine may be provided with a determination portion configured to determine whether the amount of the liquid piston is larger than a predetermined amount. In this case, the liquid piston discharge portion may be configured to discharge a part of the liquid operation fluid as the liquid piston when the determination portion determines that the amount of the liquid piston is larger than the predetermined amount. Furthermore, the liquid piston discharge portion may include a discharge pipe that is connected to the container such that a part of the liquid operation fluid as the liquid piston is discharged via the discharge pipe, and an electromagnetic valve configured to open and close the discharge pipe. In this case, the container is configured such that a lowest pressure of an inner pressure of the container is capable to be lower than the atmosphere pressure, and a one-way valve is located in the discharge pipe to prevent a reverse flow of the liquid operation fluid as the liquid piston when the lowest pressure of the inner pressure of the container is lower than the atmosphere pressure.

Alternatively, the determination portion may determine that the amount of the liquid piston is larger than the predetermined amount, when a temperature at a predetermined position of the container is lower than a threshold value.

The heat engine may further include a cooling portion located at a portion of the container between the one end side of the container and the other end side of the container to cool and condense the vapor drawn from the vapor suction portion into the container. In this case, the cooling portion is configured to cool the vapor by performing heat exchange between the vapor and a coolant, and the determination portion determines that the amount of the liquid piston is larger than the predetermined amount, when a temperature of the coolant is lower than a threshold value.

Alternatively, the determination portion may determine that the amount of the liquid piston is larger than the predetermined amount, when an average pressure of an inner pressure in the container is lower than a threshold value.

In the heat engine, the vapor suction portion and the vapor discharge portion may be provided in a vapor valve having a pulley that is synchronously coupled with a pulley of the output portion, or the vapor valve may be electrically synchronized with an output shaft of the output portion without being mechanically connected to the output shaft of the output portion.

According to another aspect of the present invention, a heat engine includes a container with a tube portion in which a liquid piston made of a liquid operation fluid is sealed to flow therein, an exterior evaporator located outside of the container to generate vapor of the operation fluid, a vapor suction portion arranged at one end side of the container to draw the vapor generated in the exterior evaporator into the container, an expansion portion provided in the container in which the vapor drawn from the vapor suction portion is expanded to cause a displacement of the liquid piston in the container, an output portion arranged at the other end side of the container to convert the displacement of the liquid piston to a mechanical energy and to output the converted mechanical energy, a liquid piston discharge portion configured to discharge a part of the liquid operation fluid as the liquid piston from the container so as to restrict an increase of an amount of the liquid piston, and a vapor discharge portion configured to discharge non-condensable gas introduced in the container to outside of the container. Because the non-condensable gas such as air is discharged from the container, it can restrict a loss for compressing the non-condensable gas mixed in the vapor from being generated, thereby heat energy conversion efficiency can be improved.

BRIEF DESCRIPTION OF THE DRAWINGS

Additional objects and advantages of the present invention will be more readily apparent from the following detailed description of preferred embodiments when taken together with the accompanying drawings. In which.

DETAILED DESCRIPTION OF THE PREFERRED EMBODIMENTS

Figure 1:
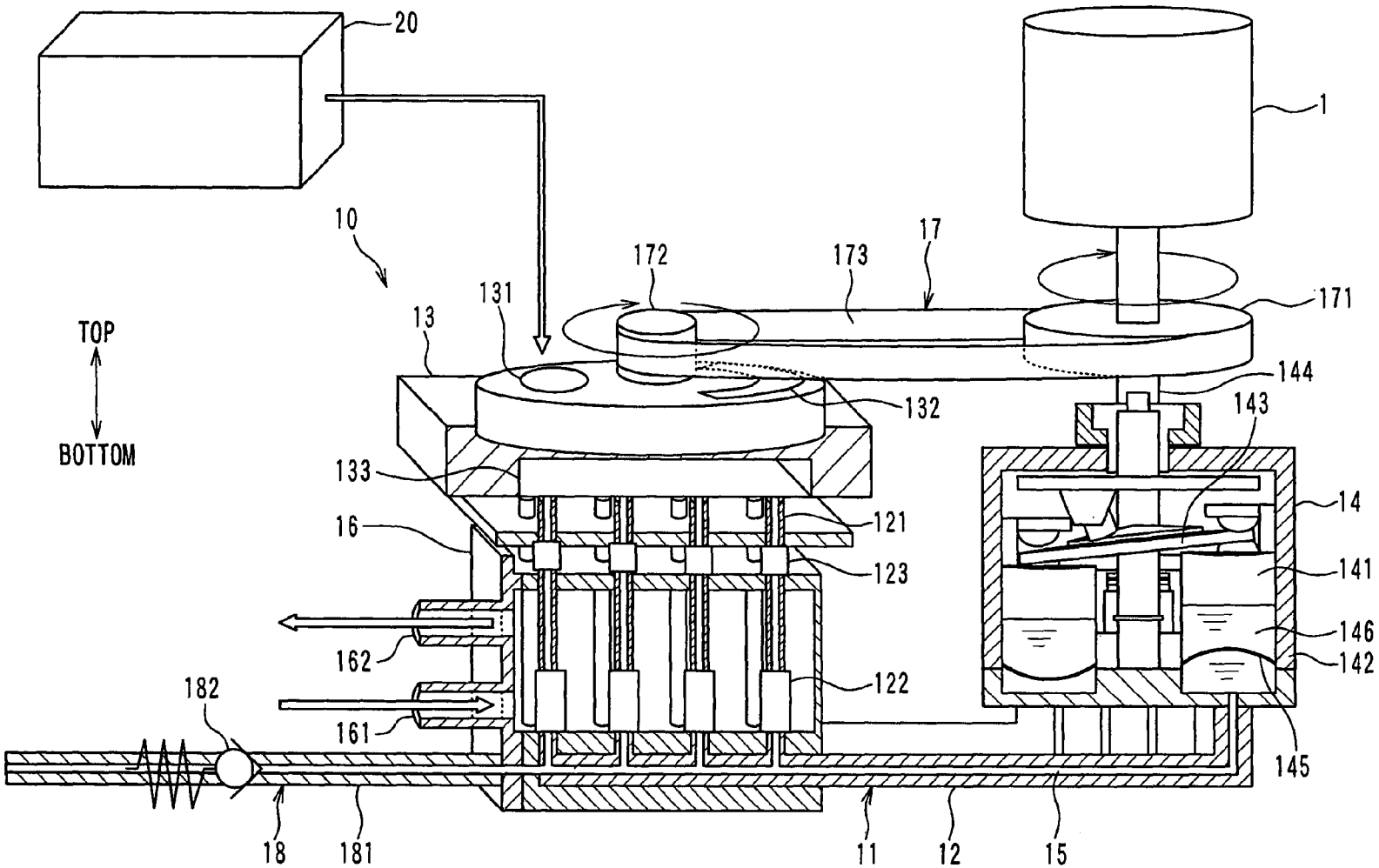
FIG. 1 is a schematic diagram showing a heat engine according to a first embodiment of the invention.

Embodiments of the present invention will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

Figure 2B:
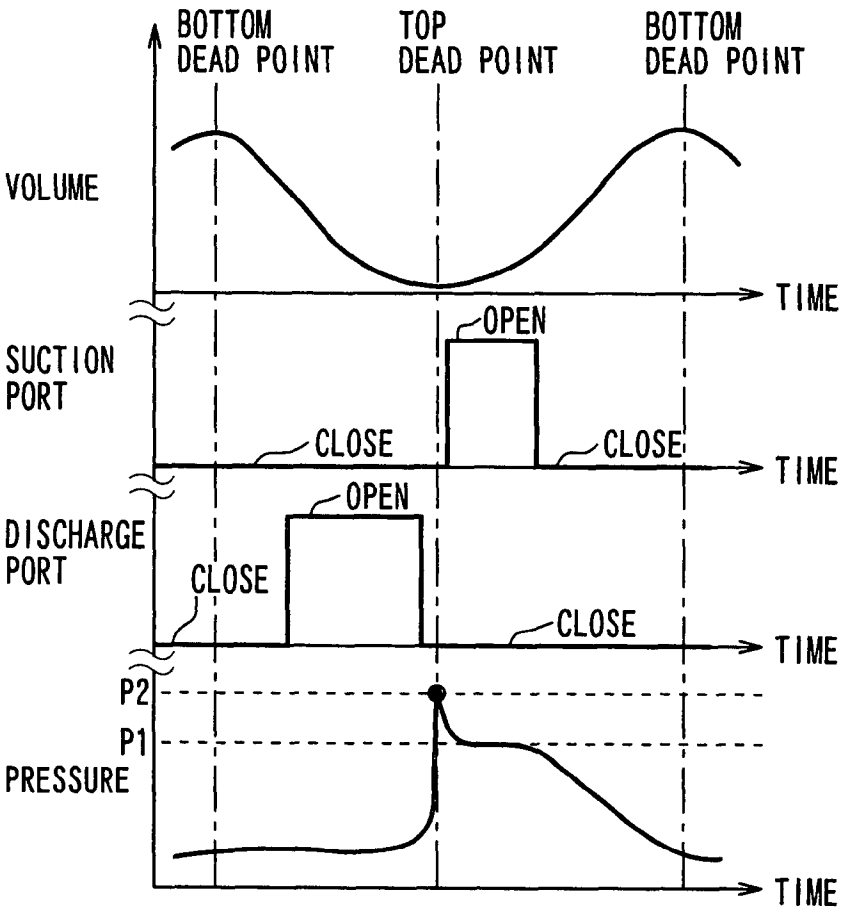
FIG. 2B is a time chard showing operation of the heat engine, according to the first embodiment.

A first embodiment of the present invention will be described hereafter with reference to FIGS. 1 to 3. FIG. 1 is a schematic diagram showing a heat engine 10 according to the first embodiment. In FIG. 1, the top direction indicates an upper side of the heat engine 10, and the bottom direction indicates a lower side of the heat engine 10.

The heat engine 10 is also called as a liquid-piston vapor engine, and is adapted as a driving source for driving a device (e.g., electrical generator) to be driven.

The heat engine 10 includes a container 11 in which a liquid operation fluid (e.g., water) is sealed to flow therein in a liquid state, and an exterior evaporator 20 for supplying vapor operation fluid (e.g., steam) into the container 11.

The exterior evaporator 20 heats water which is an example of the operation fluid, and generates steam. In the present example, a high-temperature gas such as an exhaust gas is used as a heat source of the exterior evaporator 20. For example, the exterior evaporator 20 is disposed in a high-temperature gas passage through which the high-temperature gas flows, so that the operation fluid is heated and is evaporated by the high-temperature gas to generate vapor.

The container 11 includes a tube-shaped liquid piston displacement portion 12, a vapor valve 13 located at one end side of the liquid piston displacement portion 12, and an output portion 14 located at the other end side of the liquid piston displacement portion 12. Hereinafter, the liquid fluid (e.g., water, in the present embodiment), which displaces in the liquid piston displacement portion 12, is referred to as "liquid piston 15".

The vapor valve 13 is provided with a suction port 131 through which the vapor supplied from the exterior evaporator 20 is drawn into the container 11, and a discharge port 132 for discharging vapor from the container 11. The suction port 131 and the discharge port 132 are selectively opened and closed at a predetermined timing. The suction port 131 is used as a drawing portion for drawing the vapor generated in the exterior evaporator 20 into the container 11. In contrast, the discharge port 132 is adapted as a discharging portion for discharging uncondensed vapor to outside of the container 11.

The vapor valve 13 is provided with a vapor passage 133 through which the suction port 131 and the discharge port 132 communicate with one end side of the liquid piston displacement portion 12 in the container 11. The vapor passage 133 is made to communicate with the suction port 131 and the discharge port 132 at a predetermined timing. The vapor valve 13 can be configured by a rotary valve, a poppet valve or the like, for example.

An expansion portion 121 for expanding vapor supplied from the exterior evaporator 20 is provided at the one end portion of the liquid piston displacement portion 12 in the container 11. The expansion portion 121 is disposed to be heated by the high-temperature gas, similarly to the exterior evaporator 20, so as to restrict condensation of the vapor in the expansion portion 121.

A cooling portion 122 is disposed in a portion (e.g., middle portion) of the liquid piston displacement portion 12 between the one end side and the other end side of the liquid piston displacement portion 12, to cool and condense the vapor expanded in the expansion portion 121. In the example of FIG. 1, the liquid piston displacement portion 12 is branched into plural tube parts at a position where the expansion portion 121 and the cooling portion 122 are formed.

The cooling portion 122 is inserted into a cooler 16. The cooler 16 is provided with a coolant inlet 161 for introducing a coolant (cooling fluid) into the cooler 16, and a coolant outlet 162 for discharging the coolant, so that the coolant is circulated.

The vapor expanded in the expansion portion 121 is cooled and condensed in the cooling portion 122 by performing heat exchange with the coolant in the cooling portion 122. The cooler 16 is provided in a coolant circuit, and a radiator (not shown) is arranged in the coolant circuit to radiate heat of the coolant, transmitted from the vapor.

In the example of FIG. 1, a regulating portion 123 is disposed to restrict a disturbance of the liquid surface of the liquid piston 15. For example, the regulating portion 123 regulates the flow of the liquid piston, thereby restricting disturbance of the liquid surface of the liquid piston 15. Thus, it can restrict vapor from being mixed to the liquid piston 15.

The output portion 14 is configured to convert the displacement of the liquid piston 15 in the liquid piston displacement portion 12 to a mechanical energy, and to output the converted mechanical energy. The output portion 14 is configured by a swash plate-type expansion unit, for example. In this case, the output portion 14 includes a solid piston 141, a cylinder 142, a swash plate 143 and an output shaft 144 connected to the swash plate 143. The solid piston 141 displaces when a pressure from the liquid piston 15 is applied to the solid piston 141, and is slidably held in the cylinder 142. The swash plate 143 is pressed by the solid piston 141 to be moved.

An inertial force generating member (not shown), such as a flywheel, is connected with the output shaft 144. A diaphragm 145 is disposed in the cylinder 142. An oil 146 for lubricating the solid piston 141 is sealed in the cylinder 142 at a side of the solid piston 141. The diaphragm 145 is adapted as an oil separation film for separating the liquid fluid and the oil 146 from each other in the cylinder 142.

When the liquid piston 15 in the liquid piston displacement portion 12 displaces toward the output portion 14, the oil 146 is pushed out by the diaphragm 145, and the solid piton 141 is pressed and moved upwardly in FIG. 1.

In this case, the swash plate 143 is pressed by the solid piston 141 in accordance with a movement of the solid piston 141, and thereby the output shaft 144 connected to the swash plate 143 is rotated. The output shaft 144 is connected to an electrical generator 1 that is an example of the device to be driven. By the rotation of the output shaft 144, the electrical generator 1 is driven.

When the output shaft 144 rotates, the solid piston 141 moves back toward downwardly in FIG. 1, by the inertial force of the inertial force generating member (not shown).

A synchronous unit 17 drives the vapor valve 13 synchronizing with the rotation of the output shaft 144. In the present embodiment, the vapor valve 13 is mechanically connected to the output shaft 144 by the synchronous unit 17, so that the vapor valve 13 and the output shaft 144 are synchronized by the synchronous unit 17. In the example of FIG. 1, the synchronous unit 17 is constructed by pulleys 171, 172 and a belt 173.

The liquid piston discharge portion 18 is configured to discharge a part of the liquid operation fluid as the liquid piston 15 to outside of the container 11, thereby maintaining the liquid piston 15 in the container 11 at a predetermined amount. More specifically, the liquid piston discharge portion 18 is configured by a relief valve 182 for opening and closing a discharge pipe 181. The discharge pipe 181 is connected to a tube portion in the container 11, by which the cooling portion 122 and the output portion 14 are connected with each other. The relief valve 182 is opened when the inner pressure of the container 11 is equal to or larger than a predetermined pressure.

In the present embodiment, because water is used as the operation fluid, the container 11 is made basically of a stainless steel. However, the expansion portion 121 and the cooling portion 122 may be made of a material having a high heat conductivity, such as copper or aluminum, in the container 11.

Next, operation of the heat engine will be described with reference to FIGS. 2A and 2B.

Figure 2A:
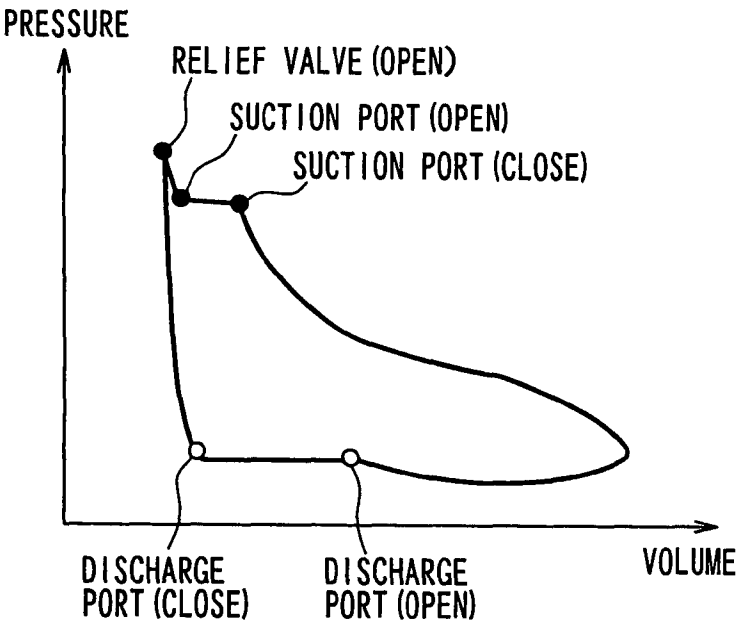
FIG. 2A is a graph showing a relationship between a pressure and a volume of a container.
Figure 3:
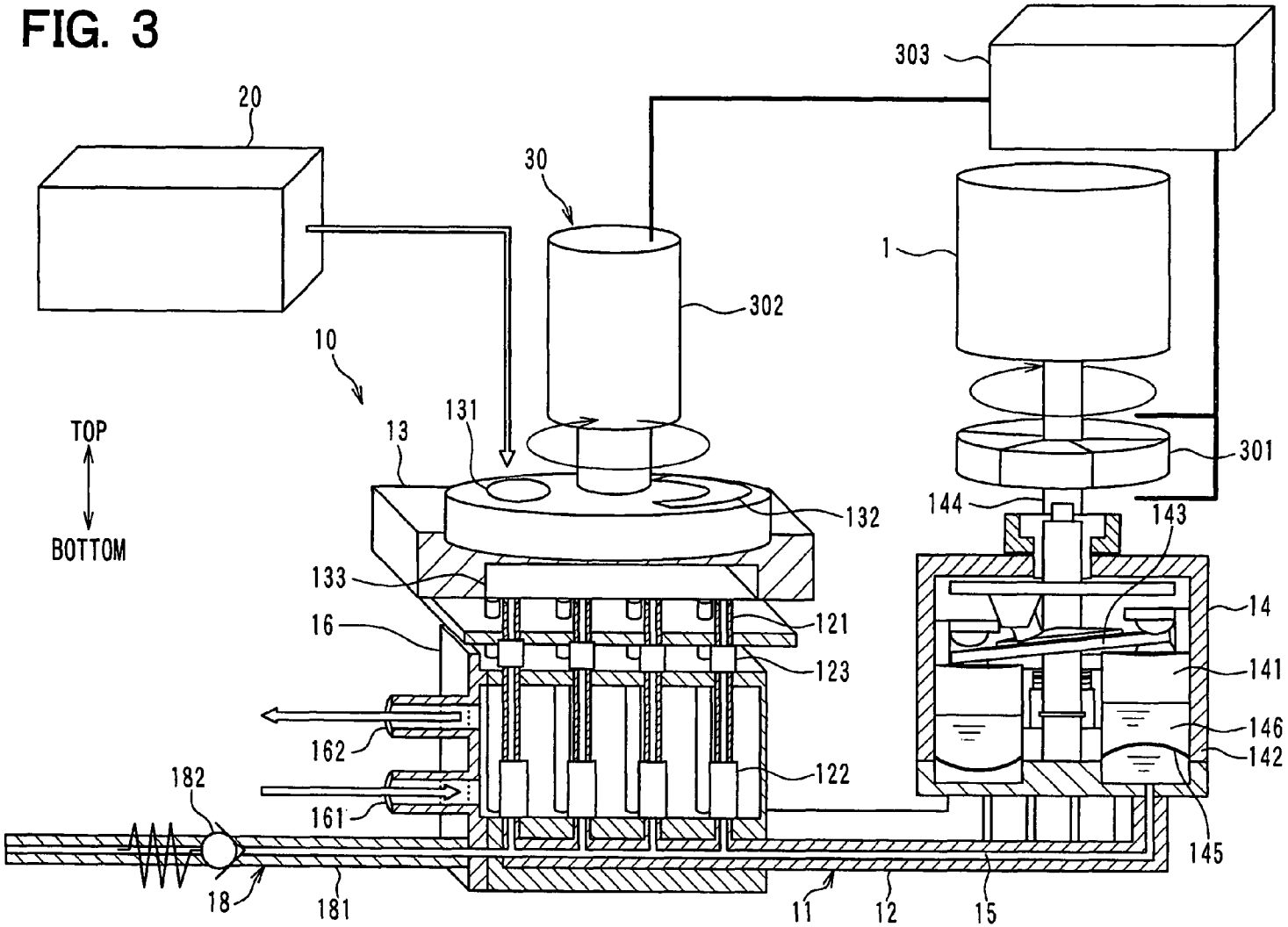
FIG. 3 is a schematic diagram showing a heat engine according to a second embodiment of the invention.

FIG. 2A is a graph showing relationships between a volume of the container 11 and an inner pressure of the container 11, in accordance with displacement of the solid piston 141. In FIGS. 2A and 2B, the pressure means the inner pressure of the container 11, the top dead point shows a first state where the liquid piston 15 is placed most at the side of the expansion portion 121, and the bottom dead point shows a second state where the liquid piston 15 is placed most at the side of the output portion 14.

As shown in FIG. 2B, at a state immediately after the liquid piston 15 reaches to the top dead point, the suction port 131 is opened by the operation of the vapor valve 13, and thereby vapor is drawn into the expansion portion 121 from the exterior evaporator 20. In FIG. 2B, P1 indicates a vapor pressure drawn to the expansion portion 121, and P2 indicates a valve open pressure at which the relief valve 182 is opened.

When the suction port 131 is closed after being opened for a predetermined time, high-temperature and high-pressure vapor supplied to the expansion valve 121 is expanded, and thereby the liquid piston 15 is pushed toward the side of the output shaft 14. At this time, the displacement direction of the liquid piston 15 corresponds to an expansion direction. In an expansion stroke of the heat engine, the liquid piston displaces in the expansion direction.

In the expansion stroke of the heat engine, the output shaft 144 of the output portion 14 is rotated by the displacement of the liquid piston 15 in the expansion direction, to output mechanical energy.

When the vapor expanded in the expansion portion 121 moves into the cooling portion 122, and the liquid surface of the liquid piston 15 is lowered to the cooling portion 122, the vapor is cooled and condensed by the cooling portion 122. Thus, a force for pushing the liquid piston 15 to the output portion 14 disappear, and thereby the solid piston 141 returns to the side of the top dead point by the inertial force of the inertial force generating member. At this time, the displacement direction of the liquid piston 15 corresponds to a compression direction. In a compression stroke of the heat engine, the liquid piston 15 displaces in the compression direction.

In the compression stroke, the discharge port 132 is opened by the operation of the vapor valve 13 at a predetermined timing, and thereby the vapor that is not condensed in the cooling portion 122 is discharged to outside of the container 11 via the discharge port 132. As shown in FIG. 2B, the discharge port 132 is closed at a time immediately before the liquid piston 15 reaches the top dead point.

By repeating the compression stroke and the expansion stroke, the liquid piston 15 within the liquid piston displacement portion 12 is periodically displaced, and thereby the output shaft 144 of the output portion 14 is continuously rotated. That is, by repeating the compression stroke and the expansion stroke in the container 11 of the heat engine, the liquid surface of the liquid piston 15 is displaced between the top head point and the bottom dead point, thereby rotating the output shaft 144 in the output portion 14.

In the compression stroke, the vapor supplied from the exterior evaporator 20 is cooled and condensed by the cooling portion 122, and thereby the liquid amount of the liquid piston 15 in the container 11 is increased by the condensed liquid. When the liquid amount of the liquid piston 15 within the container 11 is increased, the liquid surface of the liquid piston 15 is increased, and thereby the volume of vapor within the container 11 becomes smaller.

Thus, the pressure in the container 11 is increased by compression of the vapor from a state, where the discharge port 132 is closed, to a state reaching to the top dead point of the liquid piston 15. When the liquid amount of the liquid piston 15 is further increased so that the inner vapor volume becomes substantially zero in the container 11, the liquid piston 15 is compressed in the liquid state, and thereby the pressure P in the container 11 is rapidly increased at a position near the top end point.

When the pressure of the liquid piston 15 within the container 11 becomes equal to or larger than the relief-valve open pressure P2, the relief valve 182 of the liquid piston discharge portion 18 is opened so that a part of the liquid operation fluid as the liquid piston 15 is discharged outside from the liquid piston discharge pipe 181 of the liquid piston discharge portion 18.

When the pressure of the container 11 becomes lower than a predetermined pressure by discharging a part of the liquid operation fluid as the liquid piston 15, the relief valve 182 is closed. Thus, it is possible to keep the amount of the liquid piston 15 to be equal to or smaller than a predetermined amount.

In the present embodiment, the lowest pressure in the operation cycle of the container 11 is set to be lower than the atmospheric pressure. Because the relief valve 182 is provided, it can prevent a reverse flow of the liquid piston 15 from the liquid-piston discharge pipe 181 to the container 11 by using the relief valve 182 even when the pressure of the container 11 is lower than the atmospheric pressure.

In the present embodiment, the vapor valve 13 is mechanically linked with the output shaft 144 of the output portion 14, such that the suction port 131 and the discharge port 132 are opened and closed to be periodical with the state of the liquid piston 15, thereby forming an operation cycle in which the expansion stroke and the compression stroke are repeated in the heat engine.

When the vapor valve 13 opens the discharge port 132, the vapor without being completely condensed in the cooling portion 122 and air (non-condensable gas) mixed in the vapor drawn from the suction port 131 can be discharged from the discharge port 132, thereby improving heat energy conversion efficiency.

When the timing of closing the discharge port 132 coincides with the timing at which the liquid piston 15 reaches the top dead point, the vapor and the non-condensable gas mixed in the vapor can be effectively discharged from the discharge port 132.

When a dead volume, at which the liquid piston 15 reaches to the top dead point, is set closer to zero as much as possible, the vapor and the non-condensable gas can be discharged in maximum.

If a solid piston is used instead of the liquid piston 15, the solid piston may collide with an end wall surface of the container 11, and thereby the container 11 may be damaged. Thus, in this case, it is impossible for the dead volume to be approached to zero, as much as possible. In contrast, in the present embodiment, because the dead volume can be made to be approached to zero as much as possible, the uncondensed vapor can be effectively discharged, thereby improving the heat energy conversion efficiency.

Second Embodiment

A second embodiment of the present invention will be described with reference to FIG. 3.

In the above-described first embodiment, the vapor valve 13 is mechanically connected to the output shaft 144 by the synchronous unit 17, so as to be synchronized with the output shaft 144 of the output portion 14 by the synchronous unit 17. In the second embodiment, as shown in FIG. 3, the vapor valve 13 is electrically synchronized with the output shaft 144 of the output portion 14 by a synchronous unit 30, without being mechanically connected therebetween.

Specifically, the synchronous unit 30 includes a phase detection portion 301 configured to detect a phase of the liquid piston 15 so as to detect the position of the output shaft 144, an actuator 302 configured to drive the vapor valve 13, and a controller 303 configured to control the actuator 302 based on the phase detected by the phase detection portion 301.

The controller 303 controls the actuator 302, so that the suction port 131 and the discharge port 132 are opening and closed similarly to the above-described first embodiment. In the second embodiment, the other parts are similar to those of the above-described first embodiment.

Third Embodiment

A third embodiment of the present invention will be described with reference to FIG. 4. In the above-described first embodiment, the liquid piston discharge portion 18 is configured to discharge a part of the liquid operation fluid as the liquid piston 15 positioned between the cooling portion 122 and the output portion 14 in the container 11. However, in the third embodiment, as shown in FIG. 4, a liquid piston discharging portion is configured to discharge a part of the liquid operation fluid as the liquid piston 15, from the expansion portion 121 of the container 11.

Figure 4:
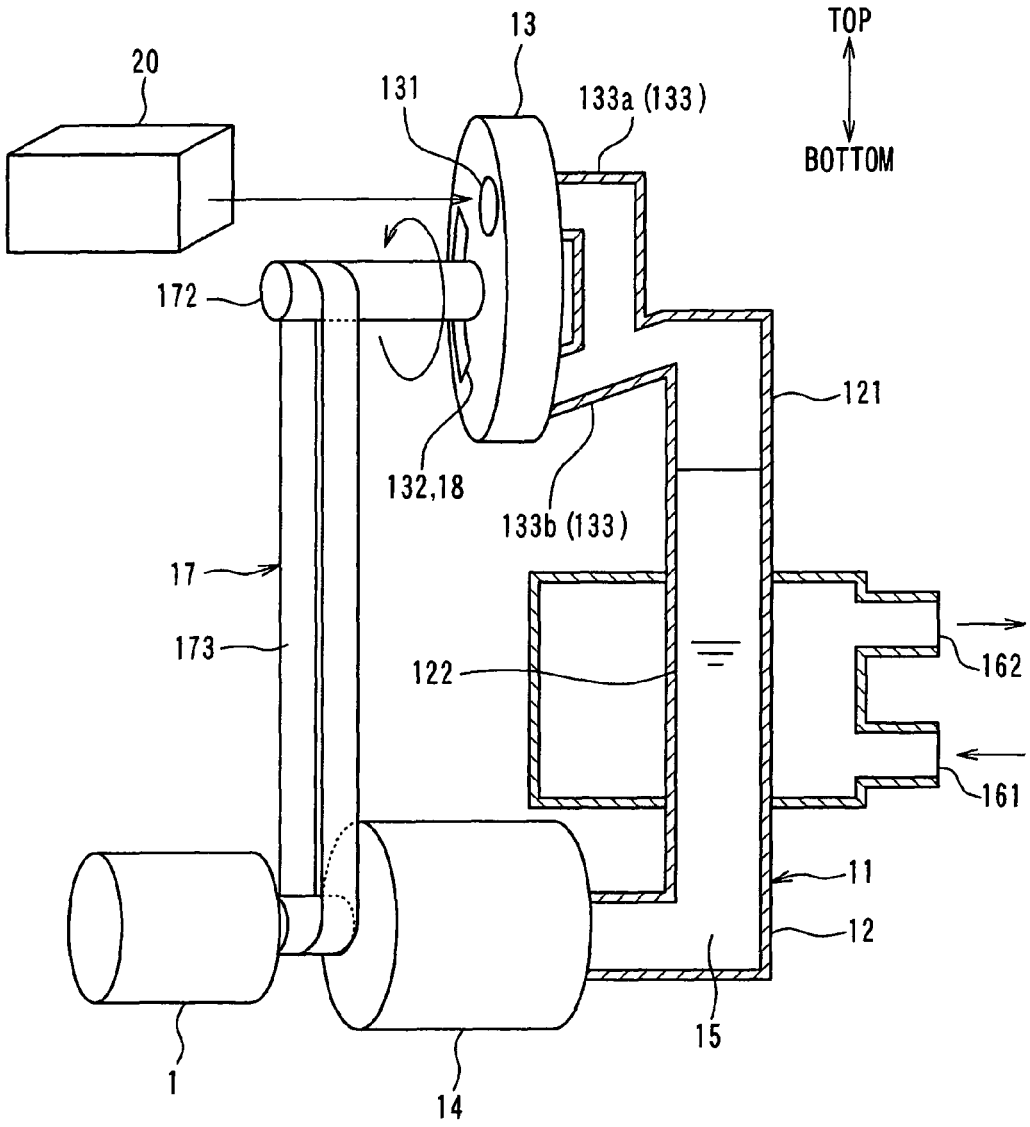
FIG. 4 is a schematic diagram showing a heat engine according to a third embodiment of the invention.

In the present embodiment, the vapor passage 133 is branched into a first branch passage 133*a* on a side of the suction port 131, and a second branch passage 133*b* on a side of the discharge port 132, as shown in FIG. 4. The second branch passage 133*b* is arranged at a lower side of the first branch passage 133*a* in the top-bottom direction.

Thus, when the amount of the liquid piston 15 is larger than a predetermined amount, a part of the liquid piston 15 can be discharged through the second branch passage 133*b* and the discharge port 132 by using a water head pressure.

Thus, the discharge port 132 can be adapted also as a liquid piston discharge portion 18, and thereby the structure of the heat engine can be made simple. That is, the discharge port 132 is used in common for a vapor discharge port for discharging the uncondensed vapor, and for a liquid piston discharge port for discharging the liquid operation fluid as the liquid piston 15.

Fourth Embodiment

A fourth embodiment of the present invention will be described with reference to FIGS. 5, 6A and 6B. In the above-described first embodiment, a part of the liquid operation fluid as the liquid piston 15 is discharged by the liquid piston discharge portion 18. However, in the fourth embodiment, as shown in FIG. 5, a liquid piston discharge portion 31 is configured such that a part of the liquid operation fluid as the liquid piston 15 is discharged by an electrical control.

The liquid piston discharge portion 31 includes a discharge pipe 311 connected to a portion of the container 11 between the cooling portion 122 and the output portion 14, an electrical valve 312 configured to open and close the discharge pipe 311, a detection portion (313, 314, 315) for detecting a physical amount relative to a liquid piston amount, and a control portion 316 for controlling operation of the electromagnetic valve 312 based on a detection value of the detection portion (313, 314, 315). The control portion 316 causes the electromagnetic valve 312 to be opened when the detection portion (313, 314, 315) detects that the amount of the liquid piston 15 is larger than a predetermined amount.

A one-way valve 317 is disposed in the liquid piston discharge pipe 311 to prevent a reverse flow of the liquid piston 15 from the liquid piston discharge pipe 311 into the container 11 when a cycle pressure of the heat engine in the container 11 is lower than the atmosphere pressure.

Figure 5:
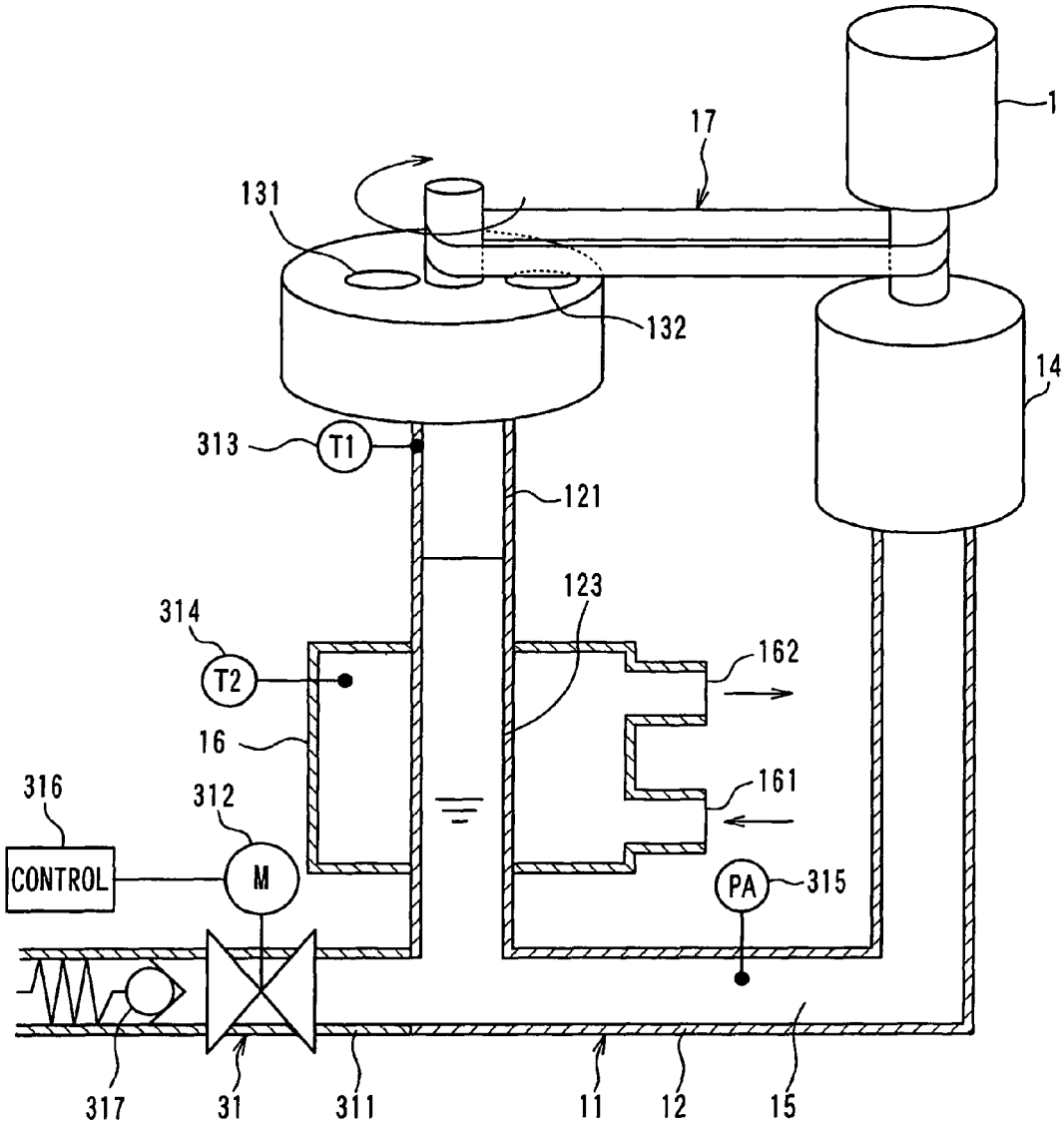
FIG. 5 is a schematic diagram showing a heat engine according to a fourth embodiment of the invention.

In the example of FIG. 5, as the detection portion, a container temperature detector 313, a coolant temperature detector 314 and an average pressure detector 315 are provided. However, at least one of the container temperature detector 313, the coolant temperature detector 314 and the average pressure detector 315 may be provided.

The container temperature detector 313 is disposed to detect a temperature (e.g., pipe wall temperature) T1 of the container 11 at a predetermined position. When the liquid piston 15 contacts a pipe wall of the container 11, the pipe wall temperature T1 decreases. In this case, the decrease of the pipe wall temperature T1 can be detected by the container temperature detector 313, so that it can determine that the liquid piston 15 becomes equal to or larger than a predetermined amount. For example, the container temperature detector 313 is located at an end side of the container 11 near the expansion portion 121.

The coolant temperature detector 314 is disposed to detect a coolant outlet temperature T2 in the cooler 16 at a side of the coolant outlet 162. When the liquid piston 15 is too long, a time period for which the vapor stays in the cooling portion 122 becomes short, and heat transmitting area between the vapor and the coolant becomes small, thereby reducing the heat exchanging amount. In this case, the coolant outlet temperature T2 detected by the coolant temperature detector 314 becomes low. Thus, when the coolant outlet temperature T2 detected by the coolant temperature detector 314 is lower than a predetermined temperature, it can determine that the amount of the liquid piston is equal to or larger than a predetermined amount.

The average pressure detector 315 is disposed to detect an average pressure PA of the cycle pressure of the heat engine. When the liquid piston 15 is too long, a space for introducing vapor in the expansion portion 121 becomes smaller, and a suction amount of vapor drawn from the vapor suction port 131 becomes smaller, thereby reducing the average pressure PA. Thus, when the average pressure detector 315 detects that the average pressure PA is lower than a predetermined value, it can determine that the liquid piston 15 becomes equal to or larger than a predetermined amount.

Figure 6A:
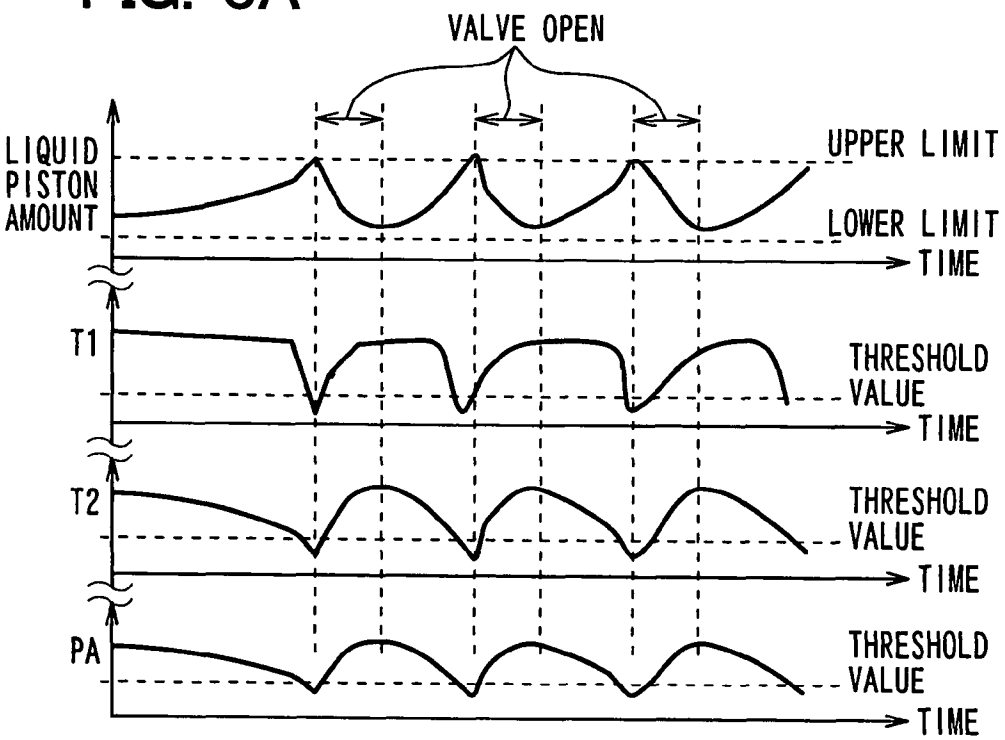
FIG. 6A is a time chard showing operation of a heat engine according to the fourth embodiment.

FIG. 6A is a time chart showing an operation example of the liquid piston discharge portion 30. In FIG. 6A, the "valve open" means a time period for which the electromagnetic valve 31 is opened. For example, the electromagnetic valve 312 is open when at least one of first to third conditions is satisfied. Here, the first condition is that the pipe wall temperature T1 detected by the container temperature detector 313 is lower than a threshold value, the second condition is that the coolant outlet temperature T2 detected by the coolant temperature detector 314 is lower than a threshold value, and the third condition is that the cycle average pressure PA detected by the average pressure detector 315 is lower than a threshold value. By controlling the operation of the electromagnetic valve 312, the liquid piston 15 can be maintained in a suitable range equal to or lower than the predetermined amount.

Figure 6B:
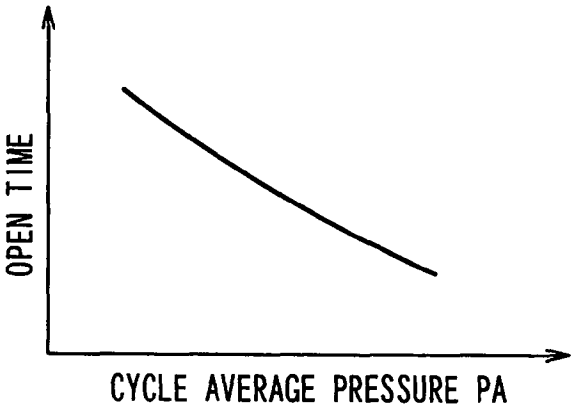
FIG. 6B is a control map of the heat engine according to the fourth embodiment.

FIG. 6B is a graph showing the relationship between an open time of the electromagnetic valve 312 and the cycle average pressure PA. In a case where the open degree of the electromagnetic valve 312 is constant, the flow amount of the liquid piston 15 discharged from the liquid piston discharge pipe 311 becomes larger as the cycle average pressure PA becomes higher. Thus, the open time of the electromagnetic valve 312 is made shorter as the cycle average pressure PA becomes higher.

According to the present embodiment, because the discharge amount of the liquid operation fluid as the liquid piston 15 can be electrically controlled by the liquid piston discharge portion 31, the liquid piston amount in the container 11 can be accurately controlled.

Other Embodiments (1) In the above-described embodiments, water is used as the operation fluid. However, as the operation fluid, other fluid such as a refrigerant may be used.

(2) In the above-described embodiments, the liquid piston 15 returns to the side of the expansion portion 121 by the inertial force of the inertial force generating member (not shown), in addition to the cooling and condensing of the vapor in the cooling portion 122. However, the liquid piston 15 may move back toward the expansion portion 121, by only using the inertial force of the inertial force generating member, without cooling and condensing the vapor in the cooling portion 122.

Even in this case, the liquid piston discharge portion 18, 31 is provided to discharge a part of the liquid operation fluid as the liquid piston 15. It is because a part of vapor may be condensed when the vapor is expanded in the expansion stroke.

Although the present invention has been fully described in connection with the preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A heat engine comprising:

a container with a tube portion;

a liquid phase of an operation fluid disposed within said tube portion forming a liquid piston within said tube portion of said container;

an exterior evaporator located outside of said container in communication with said container;

a heat source located outside of the container in communication with the exterior evaporator;

a vapor phase of said operation fluid being generated by said exterior evaporator;

a vapor suction portion arranged at one end side of said container drawing said vapor phase of said operation fluid generated in said exterior evaporator into said container;

an expansion portion provided in said container, said vapor phase of said operation fluid drawn from said vapor suction portion expanding in said expanding portion to cause a displacement of said liquid piston in said tube portion of said container;

an output portion arranged at the other end side of said container converting said displacement of said liquid piston to mechanical energy and outputting said converted mechanical energy;

a liquid piston discharge portion discharging a part of said liquid phase of said operation fluid forming said liquid piston from said container to restrict an increase of an amount of said liquid phase of said operation fluid forming said liquid piston; and a vapor discharge portion discharging a portion of said vapor phase of said operation fluid in said container to outside of said container.

2. The heat engine according to claim 1, wherein said vapor discharge portion is arranged at said one end side of said container, and said vapor discharge portion is provided with a vapor discharge port from which said vapor portion of said operation fluid is discharged, and said vapor discharge port is closed when said liquid piston is most approached to said vapor discharge portion.

3. The heat engine according to claim 1, wherein said liquid piston discharge portion discharges said part of said liquid phase of said operation fluid as said liquid piston when an inner pressure of said container is larger than a predetermined pressure.

4. The heat engine according to claim 1, wherein said liquid piston discharge portion is arranged at a lower side of said vapor suction portion such that a part of said liquid phase of said operation fluid as said liquid piston is discharged by using a fluid head pressure.

5. The heat engine according to claim 1, wherein said liquid piston discharge portion and said vapor discharge portion are provided with a common discharge port used in common for said liquid piston discharge portion and said vapor discharge portion, such that a part of said liquid phase of said operation fluid as said liquid piston is discharged from said container via said common discharge port.

6. The heat engine according to claim 1, further comprising a means for determining configured to determine whether said amount of the liquid piston is larger than a predetermined amount, wherein said liquid piston discharge portion is configured to discharge a part of said liquid phase of said operation fluid as said liquid piston when said means for determining determines that said amount of said liquid piston is larger than said predetermined amount.

7. The heat engine according to claim 1, wherein said vapor discharge portion is configured to discharge non-condensable gas in said container to an outside of said container.

8. The heat engine according to claim 1, wherein said vapor suction portion and said vapor discharge portion are provided in a vapor valve having a pulley that is synchronously coupled with a pulley of said output portion.

9. The heat engine according to claim 1, wherein said vapor suction portion and said vapor discharge portion are provided in a vapor valve, and said vapor valve is electrically synchronized with an output shaft of said output portion.

10. The heat engine according to claim 1, wherein:

said vapor phase of said operation fluid that is generated in said exterior evaporator and is drawn into said container increases an amount of said operation fluid in the container; and said part of said liquid phase of said operation fluid that is discharged from said container decreases said amount of said operation fluid in said container.

11. The heat engine according to claim 3, wherein said predetermined pressure is higher than a pressure of said vapor phase of said operation fluid drawn from said vapor suction portion into said container.

12. The heat engine according to claim 6, wherein said liquid piston discharge portion includes a discharge pipe that is connected to said container such that a part of said liquid phase of said operation fluid as said liquid piston is discharged via said discharge pipe, and an electromagnetic valve configured to open and close said discharge pipe.

13. The heat engine according to claim 6, wherein said means for determining determines that said amount of said liquid piston is larger than said predetermined amount, when a temperature at a predetermined position of said container is lower than a threshold value.

14. The heat engine according to claim 6, further comprising a cooling portion located at a portion of said container between said one end side of said container and said other end side of said container to cool and condense said vapor phase of said operation fluid drawn from said vapor suction portion into said container, wherein said cooling portion is configured to cool said vapor phase of said operation fluid by performing heat exchange between said vapor phase of said operation fluid and a coolant, and said means for determining determines that said amount of said liquid piston is larger than said predetermined amount, when a temperature of said coolant is lower than a threshold value.

15. The heat engine according to claim 6, wherein said means for determining determines that said amount of said liquid piston is larger than said predetermined amount, when an average pressure of an inner pressure in said container is lower than a threshold value.

16. The heat engine according to claim 12, wherein said container is configured such that a lowest pressure of an inner pressure of said container is capable to be lower than a pressure of the atmosphere, said liquid piston discharge portion further includes a one-way valve located in said discharge pipe to prevent a reverse flow of said liquid phase of said operation fluid as said liquid piston when said lowest pressure of said inner pressure of said container is lower than said pressure of the atmosphere.

17. A heat engine comprising:

a container with a tube portion;

a liquid phase of an operation fluid disposed within said tube portion forming a liquid piston within said tube portion of said container;

an exterior evaporator located outside of said container in communication with said container;

a heat source located outside of the container in communication with the exterior evaporator;

a vapor phase of said operation fluid being generated by said exterior evaporator;

a vapor suction portion arranged at one end side of said container drawing said vapor phase of said operation fluid generated in said exterior evaporator into said container;

an expansion portion provided in said container, said vapor phase of said operation fluid drawn from said vapor suction portion expanding in said expanding portion to cause a displacement of said liquid piston in said tube portion of said container;

an output portion arranged at the other end side of said container converting said displacement of said liquid piston to mechanical energy and outputting said converted mechanical energy;

a liquid piston discharge portion discharging a part of said liquid phase of said operation fluid forming said liquid piston from said container to restrict an increase of an amount of said liquid phase of said operation fluid forming said liquid piston; and a vapor discharge portion discharging a portion of said vapor phase of said operation fluid in said container to outside of said container; and a cooling portion in said container receiving and condensing said expanded vapor phase of said operation fluid from said expansion portion to supply said liquid phase of said operation fluid for said liquid piston.

18. The heat engine according to claim 17, wherein:

said vapor phase of said operation fluid that is generated in said exterior evaporator and is drawn into said container increases an amount of said operation fluid in the container; and said part of said liquid phase of said operation fluid that is discharged from said container decreases said amount of said operation fluid in said container.

19. A heat engine comprising:

a container with a tube portion;

a liquid phase of an operation fluid disposed within said tube portion forming a liquid piston within said tube portion of said container;

an exterior evaporator located outside of said container in communication with said container;

a heat source located outside of the container in communication with the exterior evaporator;

a vapor phase of said operation fluid being generated by said exterior evaporator;

a vapor suction portion arranged at one end side of said container drawing said vapor phase of said operation fluid generated in said exterior evaporator into said container;

an expansion portion provided in said container, said vapor phase of said operation fluid drawn from said vapor suction portion expanding in said expanding portion to cause a displacement of said liquid piston in said tube portion of said container;

an output portion arranged at the other end side of said container converting said displacement of said liquid piston to mechanical energy and outputting said converted mechanical energy;

a liquid piston discharge portion discharging a part of said liquid phase of said operation fluid forming said liquid piston from said container to restrict an increase of an amount of said liquid phase of said operation fluid forming said liquid piston; and a vapor discharge portion discharging a portion of said vapor phase of said operation fluid in said container to outside of said container; and a vapor discharge portion configured to discharge said vapor phase of said operation fluid without being condensed in said container to an outside of said container.

20. The heat engine according to claim 19, wherein:

said vapor phase of said operation fluid that is generated in said exterior evaporator and is drawn into said container increases an amount of said operation fluid in the container; and said part of said liquid phase of said operation fluid that is discharged from said container decreases said amount of said operation fluid in said container.

* * * * *